US011333040B2

(12) United States Patent
Slavic et al.

(10) Patent No.: US 11,333,040 B2
(45) Date of Patent: May 17, 2022

(54) TURBOCHARGER DEVICE AND METHOD FOR MOUNTING A TURBOCHARGER DEVICE

(71) Applicant: Vitesco Technologies GMBH, Hannover (DE)

(72) Inventors: Sasa Slavic, Heidelberg (DE); Bernhardt Lüddecke, Nuremberg (DE); Bruno Ferling, Beindersheim (DE); Dirk Frankenstein, Flörsheim-Dalsheim (DE); Shuo Li, Regensburg (DE); Jürgen Schindlatz, Neukirchen b. Hl.Blut (DE)

(73) Assignee: Vitesco Technologies GmbH, Regensburg (DE)

( * ) Notice: Subject to any disclaimer, the term of this patent is extended or adjusted under 35 U.S.C. 154(b) by 34 days.

(21) Appl. No.: 16/844,456

(22) Filed: Apr. 9, 2020

(65) Prior Publication Data

US 2020/0232340 A1 Jul. 23, 2020

Related U.S. Application Data

(63) Continuation of application No. PCT/EP2018/074266, filed on Sep. 10, 2018.

(30) Foreign Application Priority Data

Oct. 10, 2017 (DE) ..... 10 2017 218 053.6

(51) Int. Cl.
*F01D 25/16* (2006.01)
*F01D 25/24* (2006.01)
*F02B 37/00* (2006.01)

(52) U.S. Cl.
CPC ..... *F01D 25/162* (2013.01); *F01D 25/24* (2013.01); *F02B 37/00* (2013.01);
(Continued)

(58) Field of Classification Search
CPC ..... F01D 25/162; F01D 25/24; F04D 29/046; F04D 29/0462; F04D 29/056;
(Continued)

(56) References Cited

U.S. PATENT DOCUMENTS 5,076,766 A 12/1991 Gutknecht
5,145,334 A 9/1992 Gutknecht
(Continued)

FOREIGN PATENT DOCUMENTS

CN 205118012 U 3/2016
DE 102013207420 A1 11/2014
(Continued)

OTHER PUBLICATIONS

International Search Report and Written Opinion dated Sep. 10, 2018 from corresponding International Patent Application No. PCT/EP2018/074266.
(Continued)

*Primary Examiner* — Christopher Verdier
*Assistant Examiner* — Cameron A Corday

(57) ABSTRACT

A turbocharger device for an internal combustion engine and a method for mounting a turbocharger device are described. The turbocharger device has a housing with a locating hole, in which a turbocharger shaft is mounted by two rolling element bearings. A rolling element bearing sleeve is situated between the two rolling element bearings. The rolling element bearing sleeve and hence the two rolling element bearings are fixed with the turbocharger shaft in the axial direction with the aid of two pins, which are introduced through a hole in the housing and are pressed into a groove in the rolling element bearing sleeve. During this process, the beveled tips of the pins slide along the chamfered outer edges of the groove as far as an end position, which fixes the axial position of the rolling element bearing sleeve.

9 Claims, 10 Drawing Sheets

(52) U.S. Cl.
CPC ..... *F05D 2220/40* (2013.01); *F05D 2230/64* (2013.01); *F05D 2240/50* (2013.01)

(58) Field of Classification Search
CPC .... F04D 29/0563; F16C 23/06; F16C 35/042; F16C 35/067; B23P 2700/13; Y10T 29/4932
See application file for complete search history.

(56) References Cited

U.S. PATENT DOCUMENTS

| | | | | |
|---|---|---|---|---|
| 7,214,037 | B2 | 5/2007 | Mavrosakis | |
| 2009/0293257 | A1 | 12/2009 | Castan et al. | |
| 2010/0068053 | A1 | 3/2010 | Mathieu | |
| 2013/0115080 | A1* | 5/2013 | Castan ..... | F16C 17/10 415/229 |

FOREIGN PATENT DOCUMENTS

| | | | |
|---|---|---|---|
| EP | 1705393 | A1 | 9/2006 |
| EP | 2592291 | A2 | 5/2013 |
| WO | 2014004240 | | 1/2014 |

OTHER PUBLICATIONS

Chinese Office Action dated Dec. 28, 2021 for corresponding Chinese patent application No. 201880066423.X.

* cited by examiner

TURBOCHARGER DEVICE AND METHOD FOR MOUNTING A TURBOCHARGER DEVICE

CROSS-REFERENCE TO RELATED APPLICATIONS

This application claims priority to PCT Application PCT/EP2018/074266, filed Sep. 10, 2018, which claims priority to German Patent Application No. DE 10 2017 218 053.6, filed Oct. 10, 2017. The disclosures of the above applications are incorporated herein by reference.

FIELD OF THE INVENTION

The present invention relates to a turbocharger device for an internal combustion engine having a turbine wheel and a compressor wheel, which are arranged on a common turbocharger shaft, wherein the turbocharger shaft is mounted in a locating hole in the housing of the turbocharger device by two rolling element bearings, which are spaced apart from one another in the axial direction of the shaft, and of a rolling element bearing sleeve, which is arranged between the two rolling element bearings.

BACKGROUND OF THE INVENTION

A turbocharger device of this kind is widely known. The shaft provided with the turbine wheel and the compressor wheel is mounted in the housing of the turbocharger device by the two rolling element bearings, wherein the two rolling element bearings have inner races, which are formed on the shaft itself. A rolling element bearing sleeve, which is designed as a C ring, is provided between the two outer races of the rolling element bearings. The rolling element bearings are generally designed as ball bearings.

During the mounting of a turbocharger device of this kind, it is very important to position the entire rotor unit, i.e. the turbocharger shaft with the turbine wheel, the compressor wheel, the two rolling element bearings and the rolling element bearing sleeve arranged therebetween, precisely in the axial direction within the housing of the turbocharger device. In order to achieve this, the associated parts must therefore be manufactured with high precision.

SUMMARY OF THE INVENTION

It is then the underlying object of the present invention to provide a turbocharger device of the type described at the outset which is mounted in a simple and accurate way with a relatively wide manufacturing tolerance range.

According to the invention, this object is achieved in the case of a turbocharger device of the type stated by virtue of the fact that the rolling element bearing sleeve has a groove extending in the circumferential direction and having chamfered edges, and that the housing of the turbocharger device has a hole, which extends perpendicularly to the housing axis and in which two pins that are pressed against the chamfered outer edges of the groove are arranged.

The above-described solution according to the invention is based on the underlying concept of fixing the turbocharger shaft with the rolling element bearing system, the compressor wheel and the turbine wheel by using two pins, which, in the mounted state of the turbocharger device, extend through the hole provided in the bearing housing and into the circumferentially extending groove in the rolling element bearing sleeve. The axial position of the rolling element bearing sleeve (the C ring) and hence of the turbocharger shaft relative to the housing of the turbocharger device is fixed by pressing the pins against the chamfered edges of the groove, wherein one pin prevents a movement in one axial direction in the state in which it is pressed against the associated chamfered groove, and the other pin prevents a movement in the other axial direction in the state in which it is pressed against the associated other chamfered edge of the groove. Moreover, the pins prevent rotation of the rolling element bearing sleeve with the turbocharger shaft.

Moreover, a fine adjustment of the rolling element bearing sleeve and hence of the rolling bearings as well as of the turbocharger shaft relative to the housing of the turbocharger device may be carried out by the arrangement according to the invention. The application of this mounting principle reduces the overall tolerance chain, and the axial position of the turbocharger shaft with the turbine wheel and the compressor wheel does not depend on the accuracy and tolerances of the pins, the hole in the housing for the pins or the position of the groove in the rolling element bearing sleeve (the C ring).

If a fine adjustment of the rolling element bearing sleeve is to be carried out in the axial direction relative to the housing of the turbocharger device, one or the other pin is pressed deeper into the groove in the rolling element bearing sleeve, sliding against the chamfered edge, depending on the desired direction of movement, leading to a corresponding axial movement of the sleeve. With the axial movement of the rolling element bearing sleeve, the outer ring of the associated rolling element bearing and hence the rolling element bearing itself is moved axially with the turbocharger shaft since the inner ring of the rolling bearing is integrated into the turbocharger shaft.

The two outer edges of the groove are chamfered accordingly, and therefore corresponding oblique surfaces, along which the beveled or conically tapering heads of the pins may slide, are formed. In this case, the contact between the two pins and the chamfered edges of the groove may take place in various ways. For example, there may be point contact if a spherical surface on the head of a pin meets a flat surface on the chamfered edge of the groove or vice versa, for example. There may also be line contact if a conical surface meets another conical surface. An involute profile may also be implemented. In a contact between two surfaces, a concave surface may meet a convex surface, or a circumferential surface may meet another circumferential surface. At any rate, the invention is not restricted to one specific type of contact between the chamfered outer edges of the groove and the surface entering into contact therewith on the head of the pin.

As regards the angle at which the outer edges of the groove are chamfered, any slope angle may be employed here, and may be in a range of from 20 to 70 degrees, for example. In this case, the two slope angles may be equal or different. In every case, however, the outside diameter of both pins must be greater than the width of the groove in the rolling bearing sleeve to ensure that axial fine adjustment and, ultimately, axial fixing or locking of the rolling element bearing sleeve relative to the housing of the turbocharger device is achieved by a movement of one pin or both pins perpendicularly to the shaft axis.

As regards the design of the two pins, they are preferably of semicircular design in cross section. When the pins are in contact with one another, they therefore together form a full circle in cross section. Other cross-sectional shapes (square, oval, polygonal etc.) are likewise possible.

The tips or heads of the pins, which are in contact with the chamfered outer edges of the groove in the mounted state, are each preferably designed as a partial cone.

The two pins may be in contact with one another by their flat, mutually facing surfaces and may slide along these surfaces during their axial movements. In another embodiment, however, it is also possible for the pins to be arranged spaced apart in the associated hole. It is also possible for a lubricant feed passage to be formed or arranged between the pins.

The present invention furthermore relates to a method for mounting a turbocharger device of the type described above, in which the housing of the turbocharger device is pushed over the rolling bearing, which is pre-mounted on the turbocharger shaft, with the rolling element bearing sleeve until the groove in the rolling element bearing sleeve and the hole in the housing are substantially aligned relative to one another. After this, for fixing and fine adjustment in the axial direction, both pins are introduced into the hole and pressed by their tips against the chamfered outer edge of the groove. By way of this method, the axial position of the rolling element bearing sleeve and hence that of the turbocharger shaft with the rotors is finely adjusted, fixed and locked relative to the housing of the turbocharger device. The rolling bearing sleeve is furthermore fixed against relative rotation.

More specifically, the two rolling element bearings with the rolling element bearing sleeve arranged therebetween are in this case pre-mounted on the turbocharger shaft, and this pre-mounted unit is introduced into the locating hole in the housing of the turbocharger device. The desired axial position of the rolling element bearings is preset, and this position is fixed by using a tool. After this, the first pin is introduced into the hole in the housing of the turbocharger device until it has the correct contact with the chamfered outer edge of the groove in the rolling element bearing sleeve. The movement of the rolling element bearing sleeve in one axial direction is thus blocked. After this, the second pin is introduced in order to block the movement of the rolling element bearing sleeve in the second axial direction. If required, it is then possible, by pressing the two pins further in, to carry out fine adjustment in order to fix the end position of the rolling element bearing sleeve. In this way, rotation of the rolling element bearing sleeve is then also prevented, either due to frictional forces or due to the geometrical properties of the surfaces of the pins and the groove.

The tool provided for axial fixing is then removed. Finally, the further parts of the turbocharger device (seals, supporting plate etc.) are installed.

It is self-evident that, in the above-described method, the entire rotor unit (rolling element bearing sleeve, rolling element bearings, turbocharger shaft etc.) may be moved into the desired axial position by different insertion depths of the left-hand and right-hand pin. During the mounting process, the rotor unit may therefore be moved precisely into the desired position. When this position has been reached, locking takes place by using the pins provided.

A number of advantages are achieved with the turbocharger device designed in accordance with the invention and the mounting method according to the invention. On the one hand, the tolerance chain during the production of turbochargers provided with rolling element bearings, such as the axial tip spacing on the turbine side, is reduced. The final position of the rotors/wheels is set and fixed very precisely and in a low-cost way because the required accuracy of production of the individual parts is lower. The axial spacings between the housing and the turbine wheel as well as the compressor wheel may be reduced, and therefore thermodynamic advantages is achieved in addition.

On the other hand, an antirotation device for the rolling element bearing sleeve (the C ring) is provided by the type of mounting according to the invention. Between the two pins, it is possible to install a lubricant feed passage, which may also be provided on the outer surfaces of the pins or may extend through just one pin. Through the exploitation of selectively provided surface contacts (sphere with cone, involutes, spheres with different radii etc.), it is possible to lower the requirements in relation to the precise vertical position between the locating hole in the housing of the turbocharger device and the hole provided for the pins.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention will be explained in more detailed below with reference to exemplary embodiments in conjunction with the drawing. In the drawing.

DETAILED DESCRIPTION OF THE PREFERRED EMBODIMENTS

Figure 1:
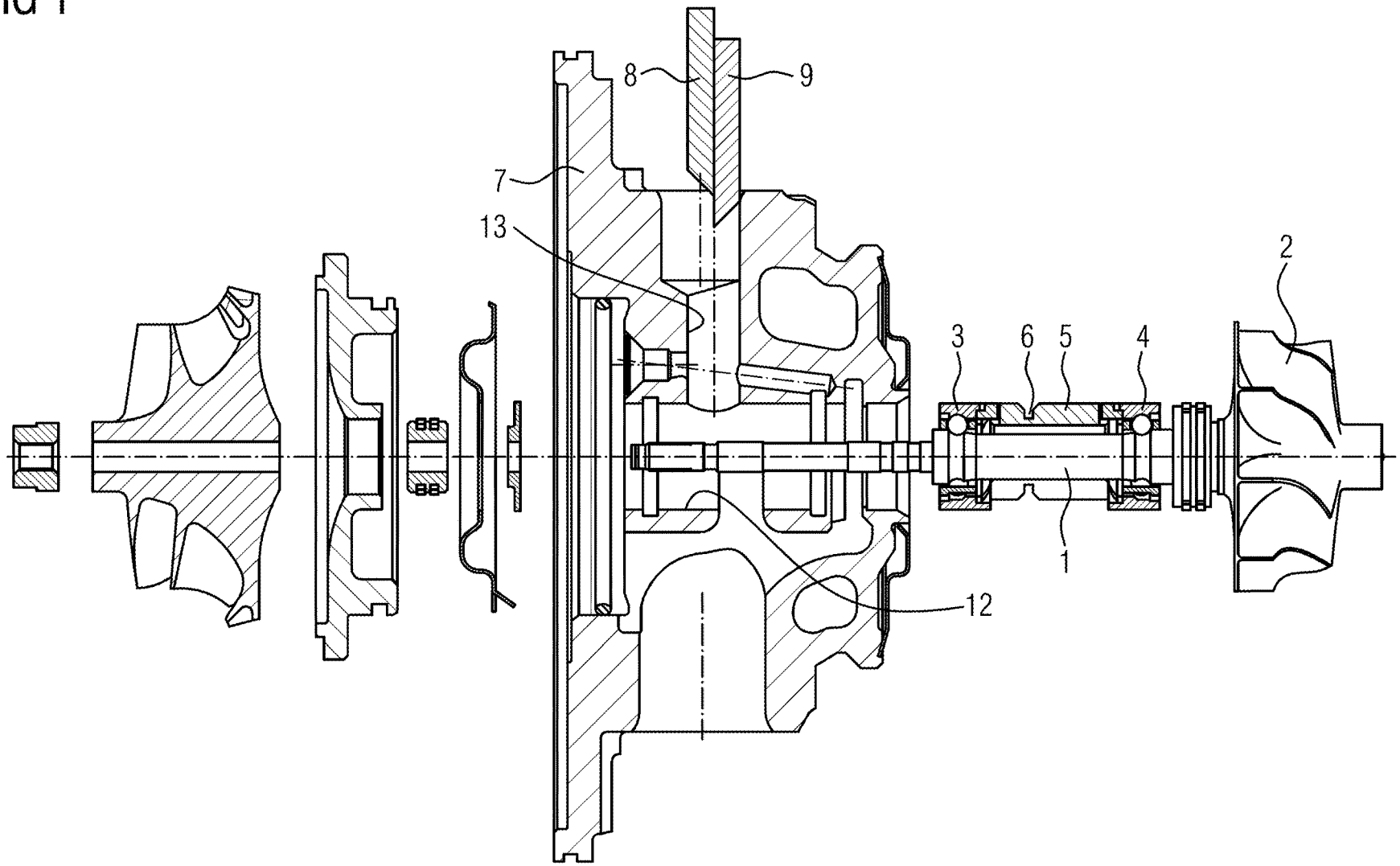
FIG. 1 shows an embodiment of a turbocharger device in vertical section in a first mounting stage.
Figure 2:
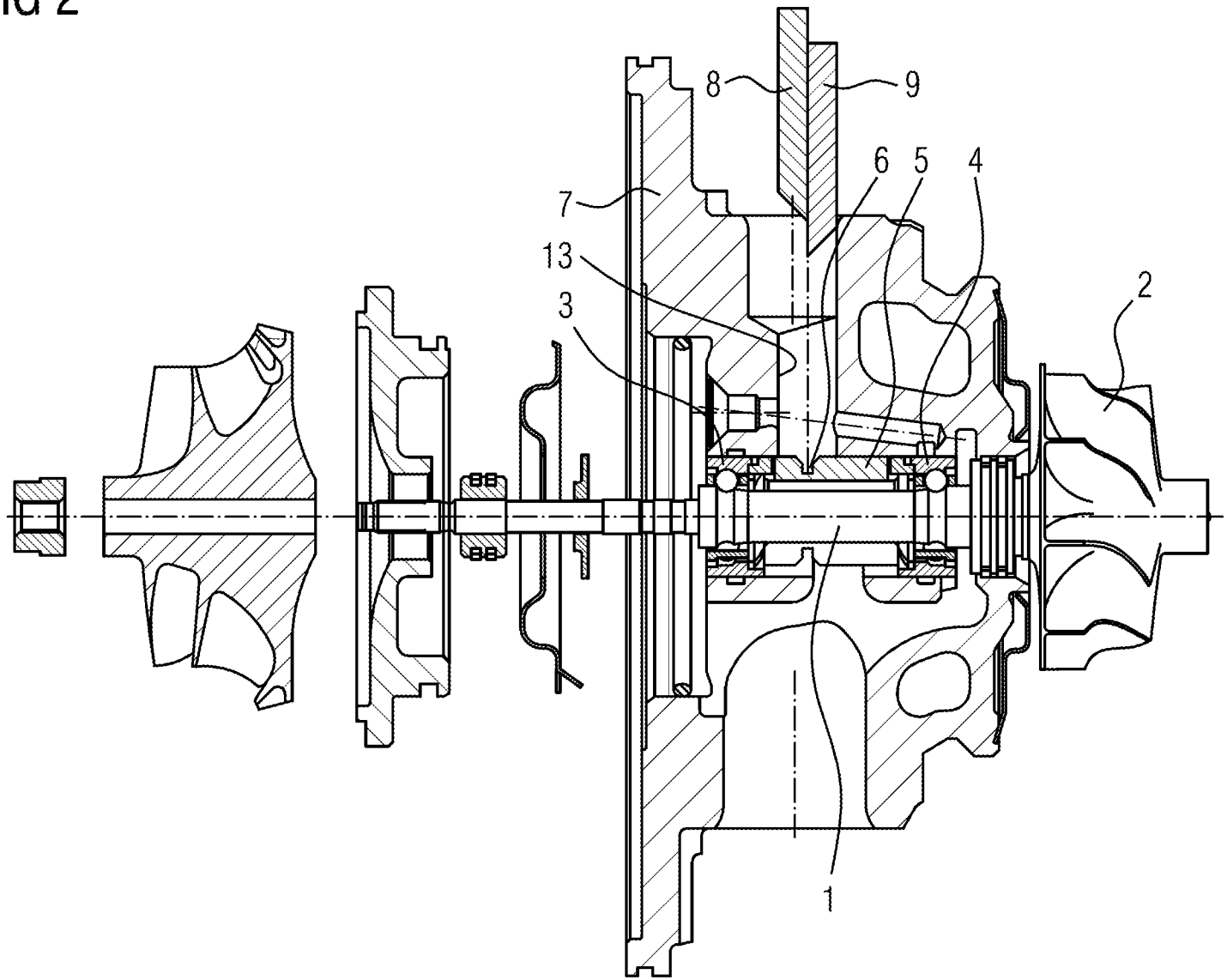
FIG. 2 shows the turbocharger device of FIG. 1 in a second mounting stage.

The following description of the preferred embodiment(s) is merely exemplary in nature and is in no way intended to limit the invention, its application, or uses.

FIGS. 1 to 5 show an embodiment of a turbocharger device in vertical section in various mounting positions. The turbocharger device illustrated has a turbocharger shaft 1, on which a turbine wheel 2 is arranged. In the mounted state of the turbocharger shaft, the corresponding compressor wheel is situated on the other end region thereof. No details of this are explained since they do not play any role in the invention.

The turbocharger device furthermore has a housing 7, in which there is a locating hole 12 for the turbocharger shaft 1. In the mounting position illustrated in FIG. 1, a first rolling element bearing (ball bearing) 3 and a second rolling element bearing (ball bearing) 4 have already been mounted on the turbocharger shaft 1. In this case, the inner rings of the two rolling element bearings 3, 4 are integrated into the turbocharger shaft 1, and therefore the positions of the rolling element bearings are fixed relative to the shaft. Between the two rolling element bearings 3, 4 there is a rolling element bearing sleeve 5, which is in the form of a C ring and which holds the two outer rings of the rolling element bearings 3, 4 apart.

Arranged in the housing 7 of the turbocharger device is a hole 13, which extends vertically relative to the housing axis and which serves to receive two mounting pins 8, 9, by which the axial position of the rolling element bearing sleeve 5 with the two rolling bearings 3, 4 and the turbocharger shaft 1 is fixed relative to the housing 7. In the mounting state illustrated in FIG. 1, the two pins 8, 9 which are introduced into the hole 13 are shown.

To fix the turbocharger shaft 1 in the housing 7, the shaft is introduced from the position shown in FIG. 1, with the pre-mounted rolling element bearing assembly, into the locating hole 12 in the housing 7 until, for instance, the axis of the hole 13 meets the center of a circumferential groove 6 arranged on the outside of the rolling element bearing sleeve 5. The turbocharger shaft is fixed in this position with the aid of a tool (not shown).

Figure 3:
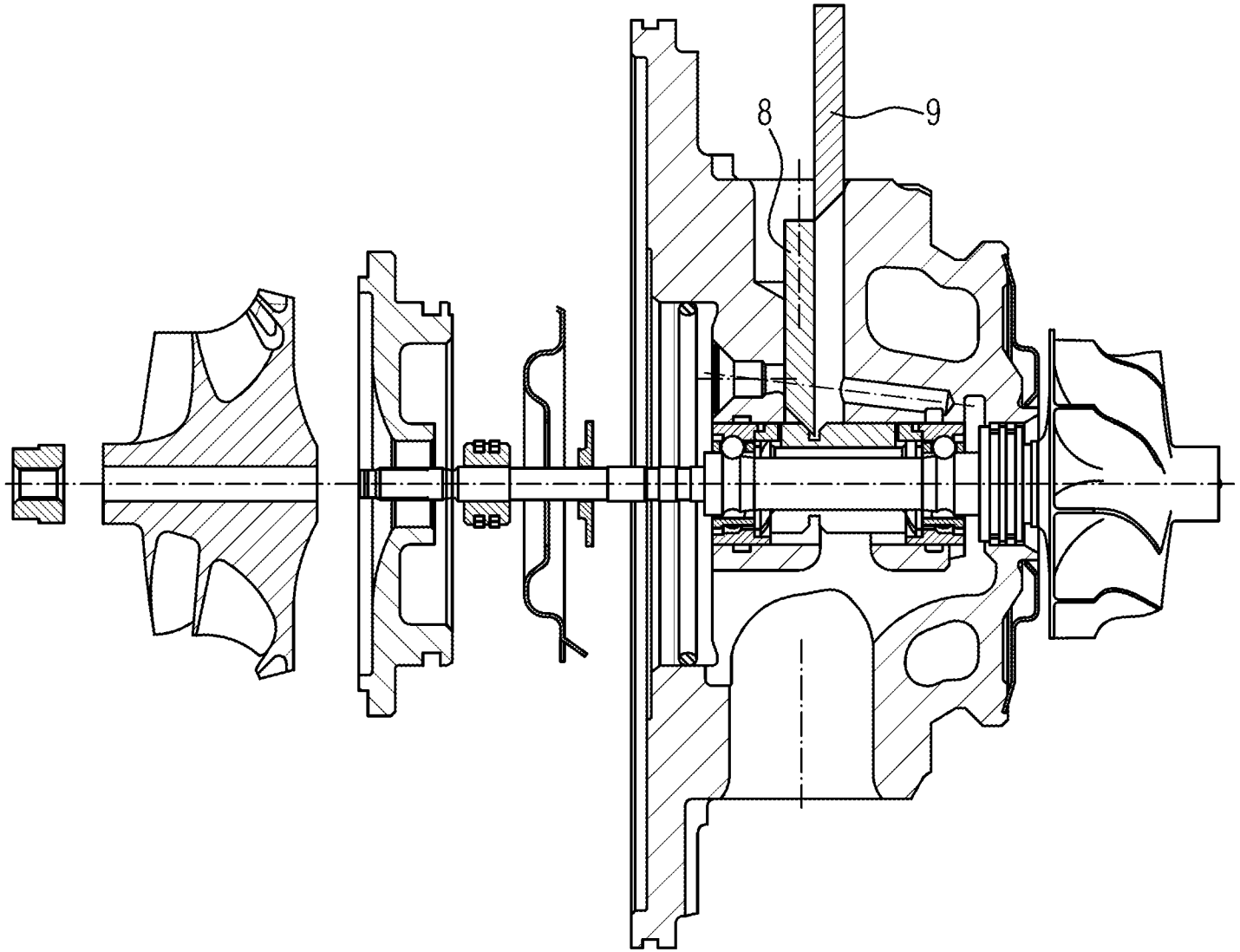
FIG. 3 shows the turbocharger device of FIG. 1 in a third mounting stage.
Figure 4:
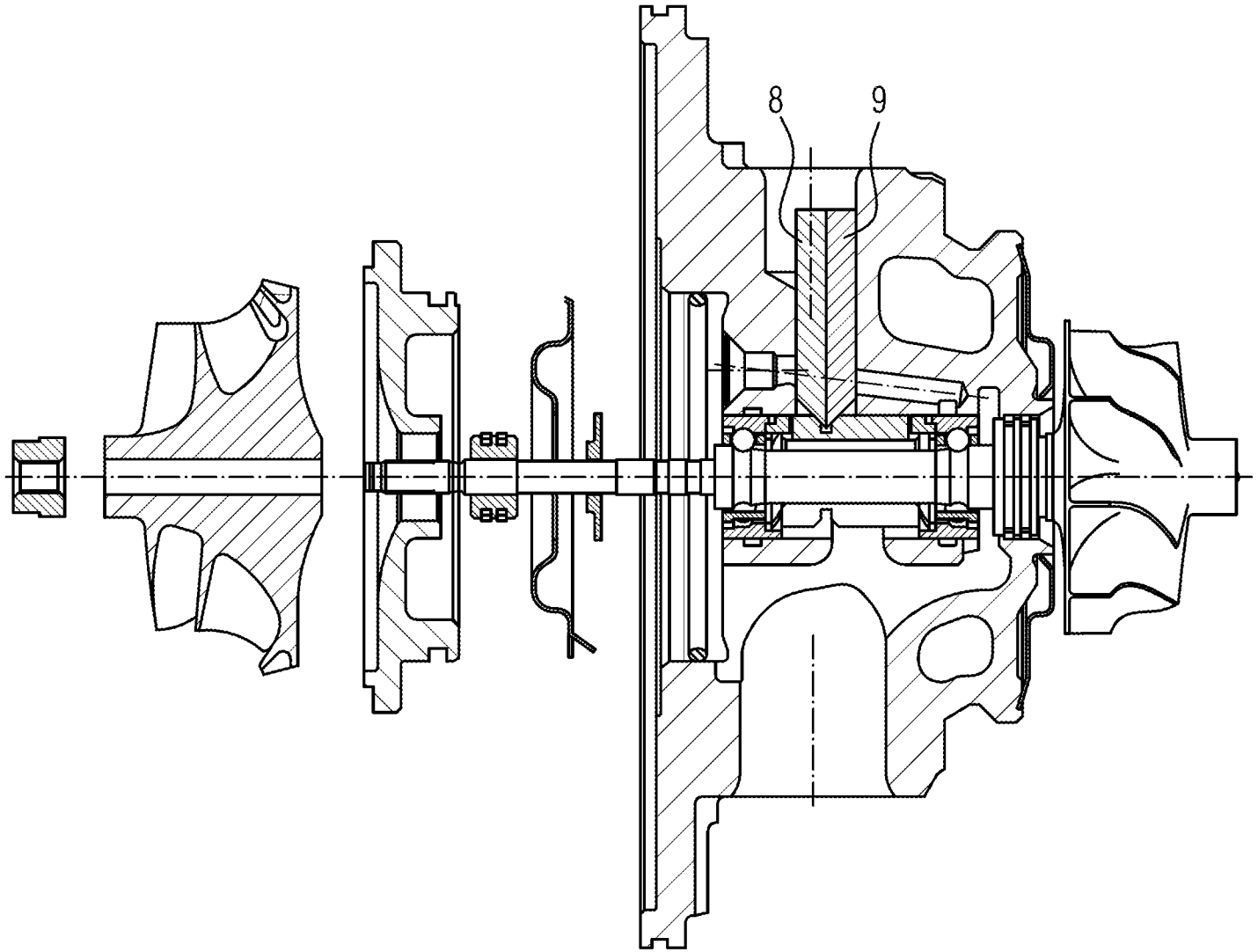
FIG. 4 shows the turbocharger device of FIG. 1 in a fourth mounting stage.
Figure 5:
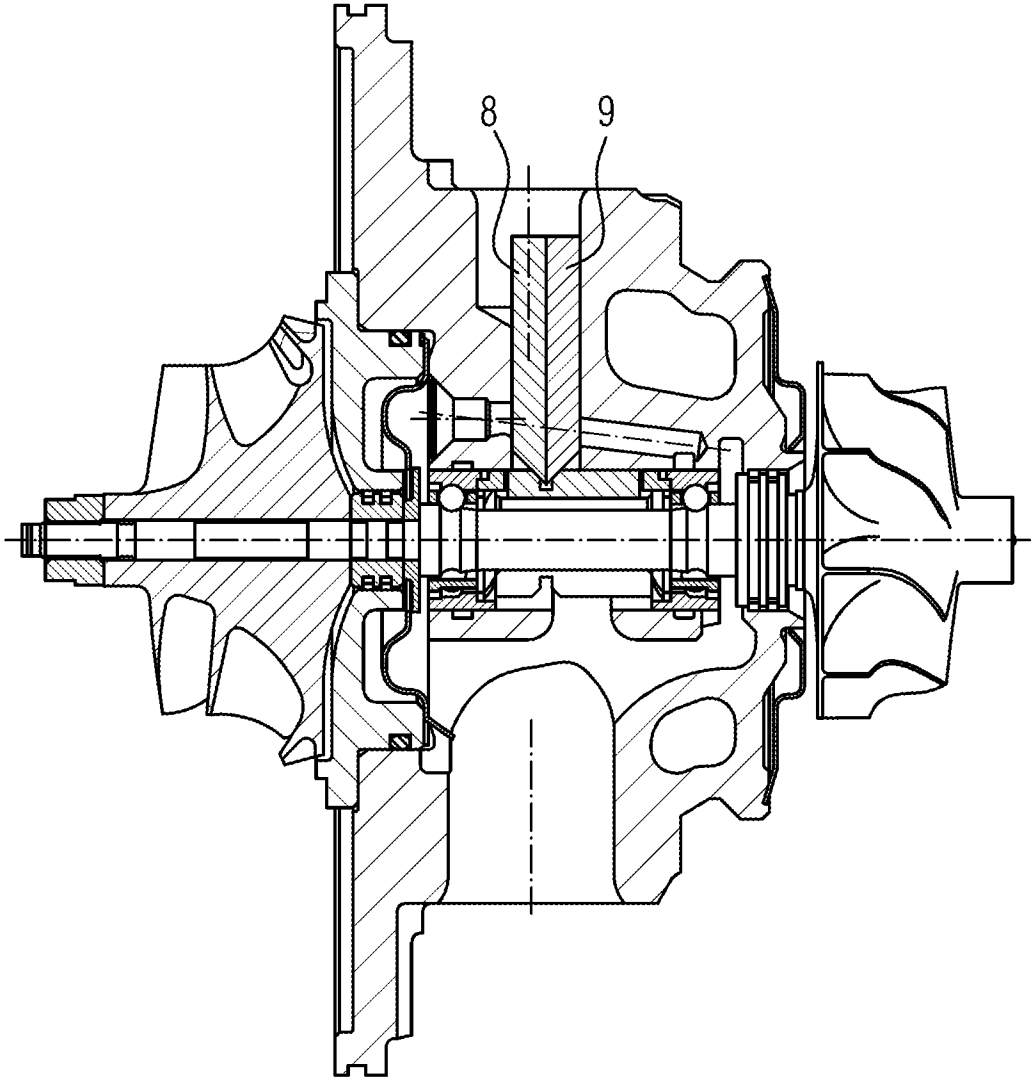
FIG. 5 shows the turbocharger device of FIG. 1 in a fifth mounting stage.

The two pins 8, 9 are now introduced into the hole 13, as shown in FIGS. 3 and 4. First of all, the left-hand pin 8 illustrated in the figures is inserted and pressed by its conically tapering tip against a correspondingly chamfered outer edge of the groove 6. Thus, the rolling element bearing sleeve 5 may no longer move in an axial direction. After this, the pin 9 on the right in the figure is pressed in, with the result that a movement in the other axial direction is thus also prevented. FIG. 5 shows both pins 8, 9 in the position in which they have been pressed into the groove 6.

Figure 6:
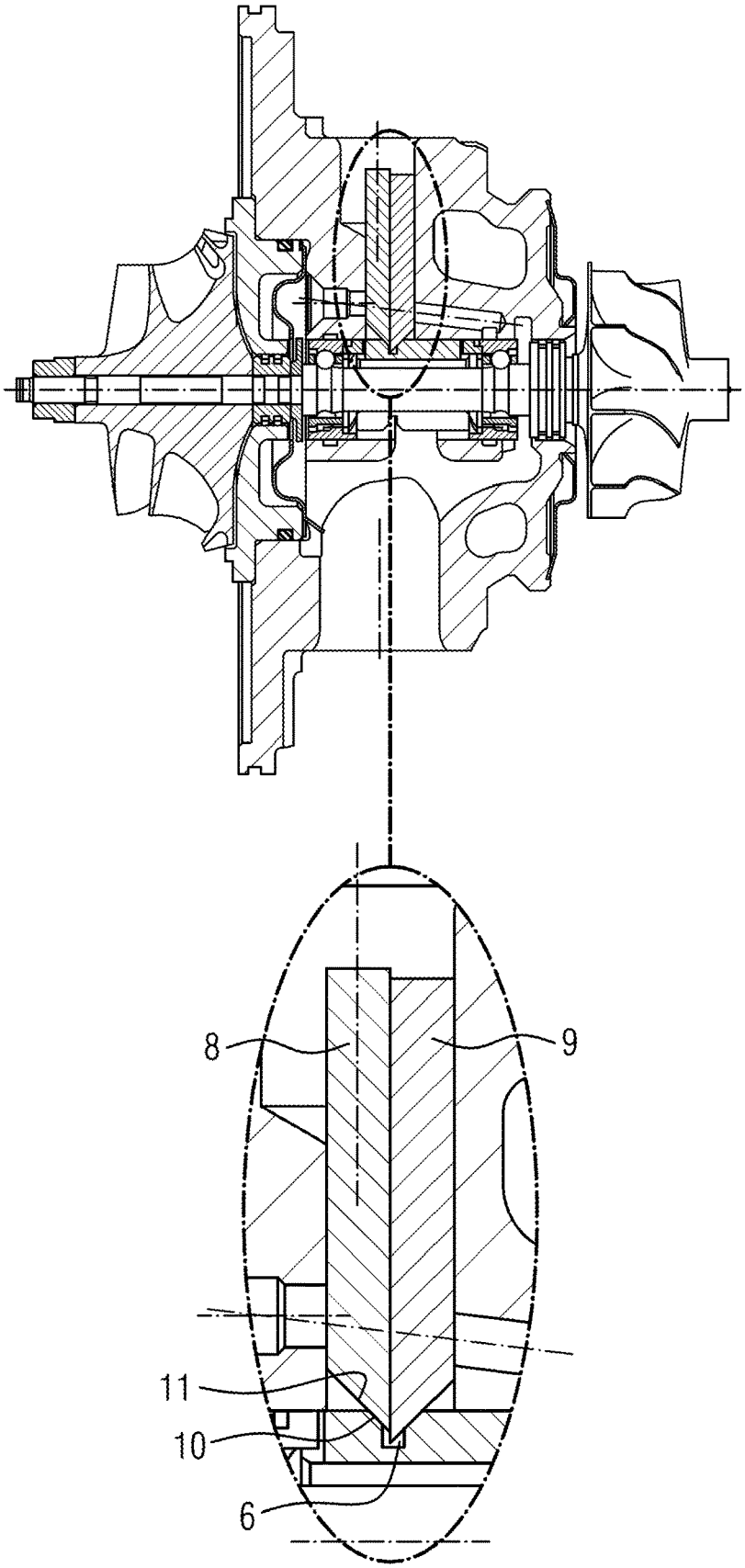
FIG. 6 shows the turbocharger device of FIGS. 1-5 in a first end position.
Figure 7:
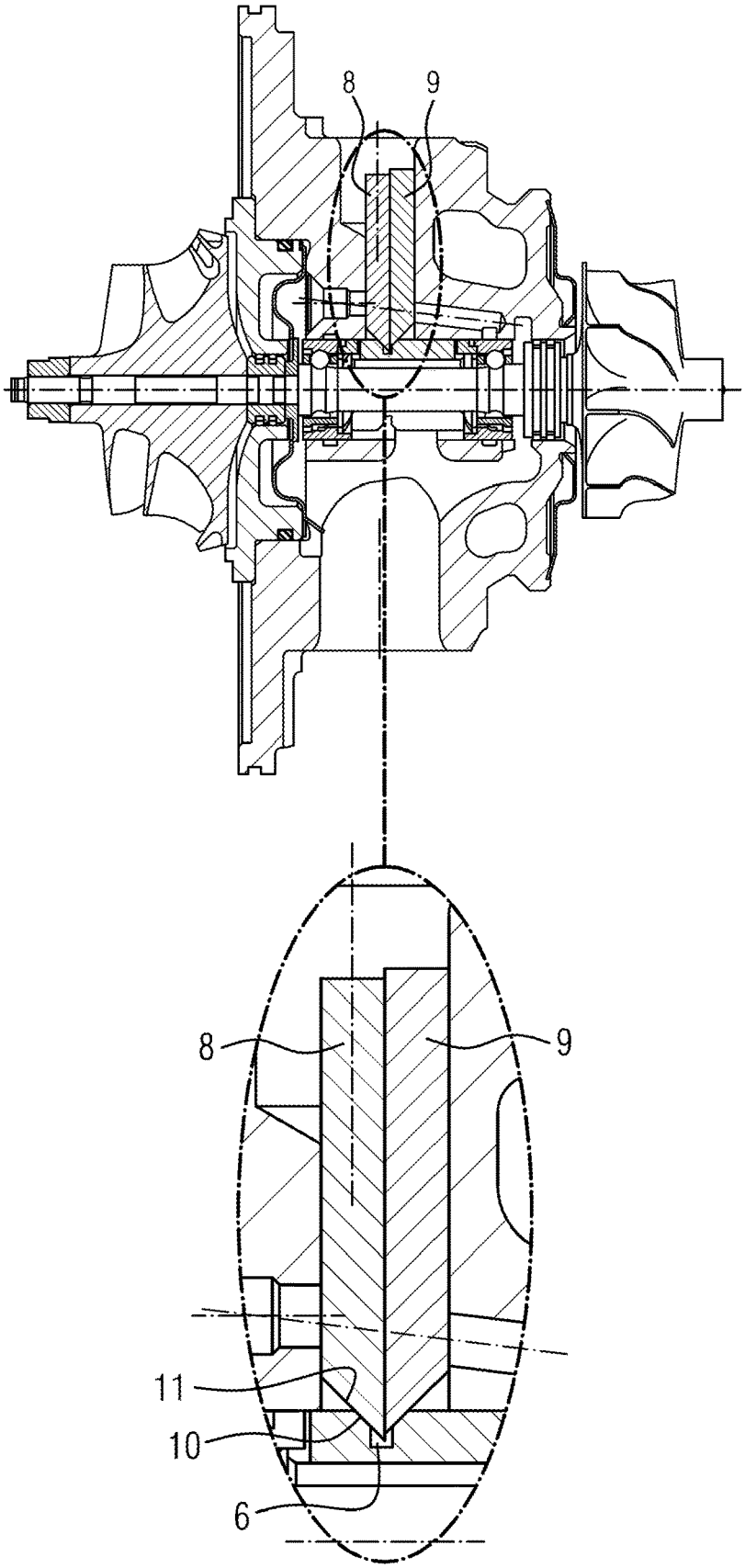
FIG. 7 shows the turbocharger device of FIGS. 1-5 in a second end position.

Details in respect of the position of the pins 8, 9 in the groove 6 are illustrated in FIGS. 6 and 7. It is seen that the axial position of the rolling element bearing sleeve 5 may be adjusted by inserting the respective pin 8, 9 to different depths since the conical surface 11 at the tip of the respective pin slides along the chamfered outer edge 10 of the groove 6 and thereby moves the rolling element bearing sleeve 5 in the axial direction. FIGS. 6 and 7 show the two end positions of the rolling element bearing sleeve 5.

When the rolling element bearing sleeve 5 and hence the turbocharger shaft 1 have reached the desired end position due to the pressing in of the pins 8, 9, the tool for fixing the shaft is removed, and the other parts of the turbocharger device may be mounted.

Figure 8:
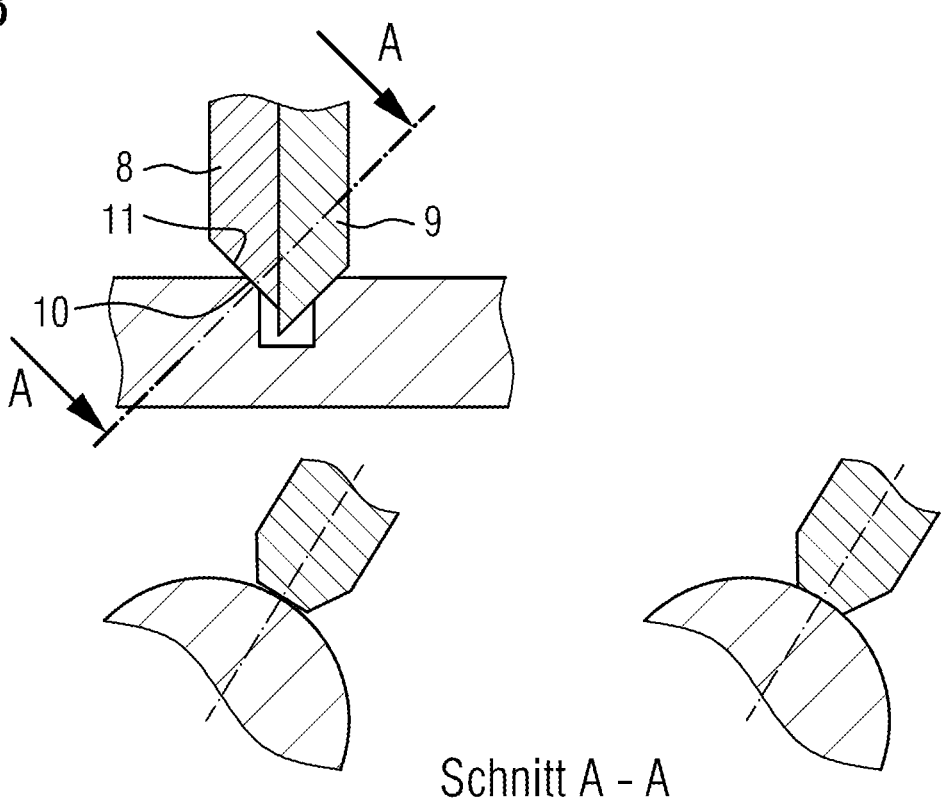
FIG. 8 shows detailed illustrations of the contact region between the mounting pins and the mounting groove in the rolling element bearing sleeve.
Figure 9:
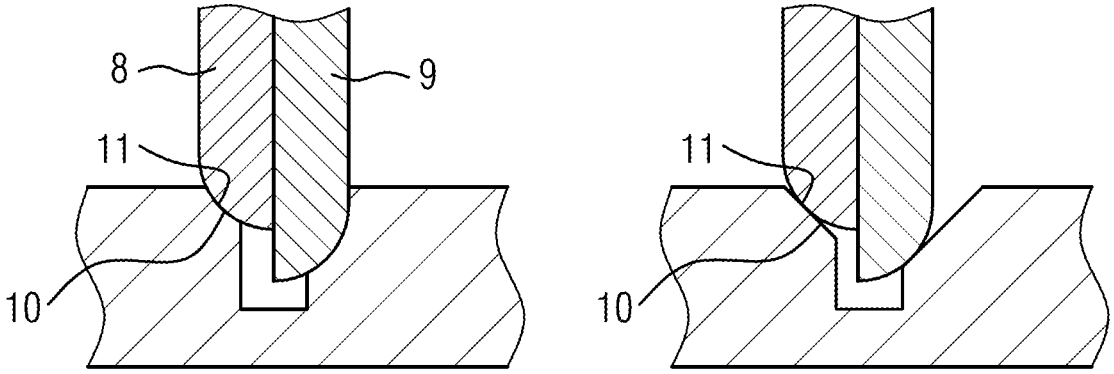
FIG. 9 shows corresponding detailed illustrations in the case of other embodiments.

The surface contact between the tip of the pins 8, 9 and the respective chamfered outer edge 10 of the groove 6 may be of different designs. FIGS. 8 and 9 show various embodiments thereof, wherein a point, line or surface contact is possible in general. In the respective sectional illustration, FIG. 8 shows a line contact in the left-hand illustration and a surface contact in the right-hand illustration. FIG. 9 shows the contact between a spherical surface and a spherical surface on the left and the contact between a spherical surface and a conical surface on the right. Any embodiments are possible as long as a corresponding effect is achieved that a movement of the two pins in the vertical direction leads to an axial movement of the rolling element bearing sleeve.

Figure 11:
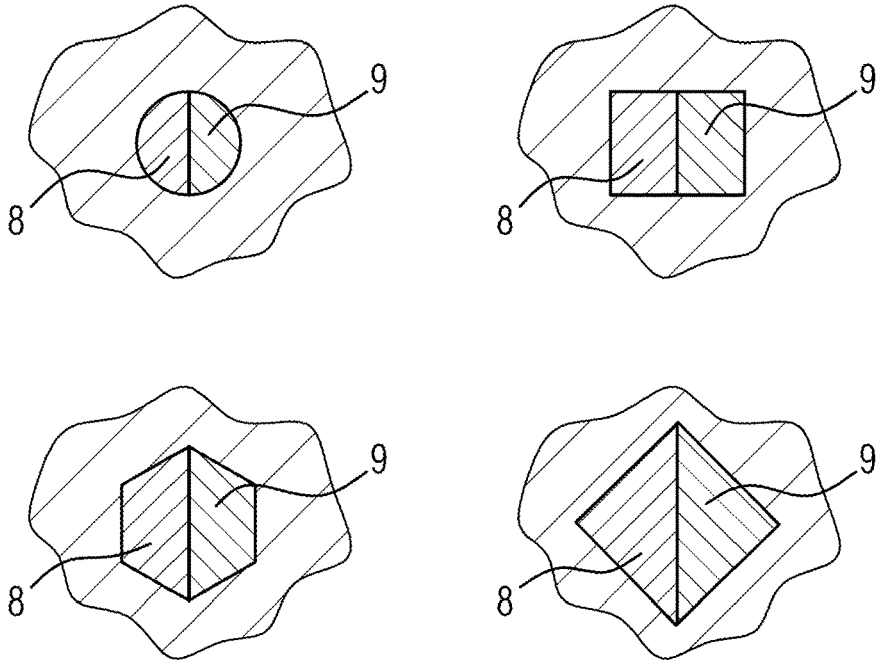
FIG. 11 shows a horizontal section through the two mounting pins of the embodiment in FIGS. 1-7 and of further embodiments.

In the above-described embodiments, the two pins 8, 9 are of semicircular design in horizontal section and rest against one another by way of their respective flat surface. This is illustrated at the top in FIG. 11. The pins 8, 9 therefore slide on one another when they are moved to fix the sleeve. Further cross-sectional shapes of the two pins 8, 9 are shown underneath in FIG. 11.

Figure 10:
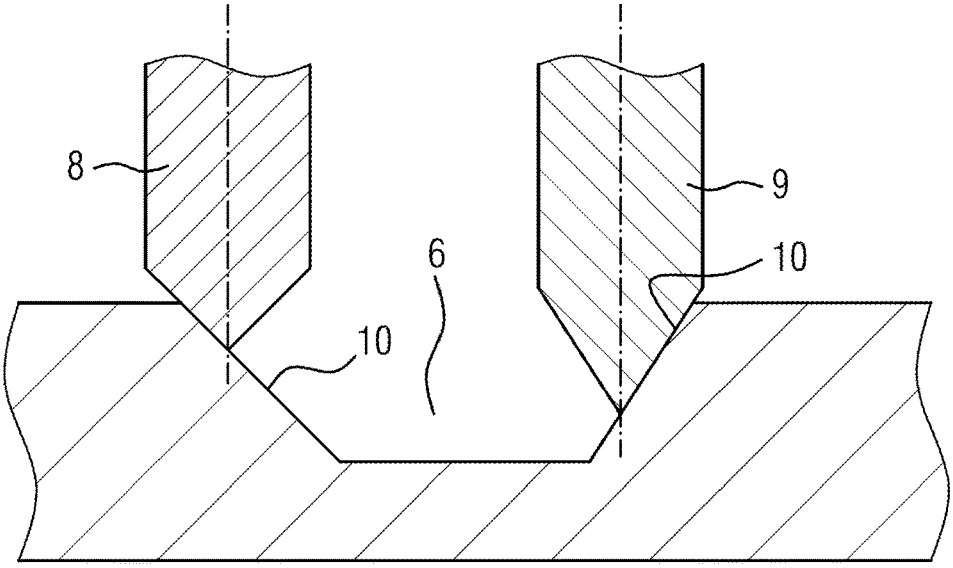
FIG. 10 shows a detailed illustration of yet another embodiment.

FIG. 10 shows an embodiment in which the pins 8, 9 are arranged spaced apart. In this case too, they have tips of conical design which are in contact with chamfered outer edges 10 of the mounting groove 6.

Figure 12:
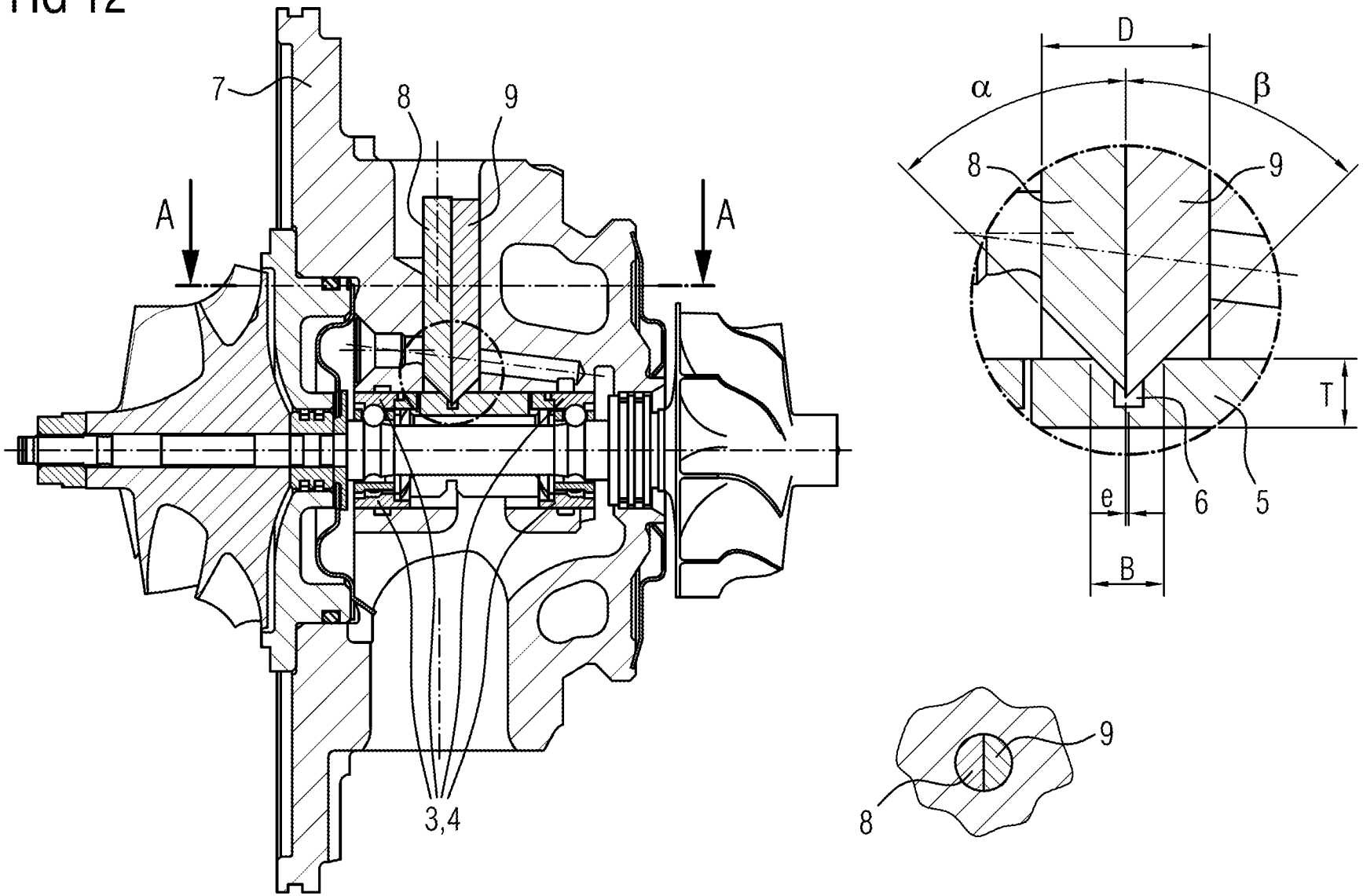
FIG. 12 shows enlarged illustrations of the turbocharger device of FIGS. 1-7 in the mounted state.

FIG. 12 shows the turbocharger device of FIGS. 1 to 7 in enlarged views in the mounted state.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A turbocharger device for an internal combustion engine, comprising:

a housing having a housing axis;

a turbine wheel;

a compressor wheel;

a common turbocharger shaft, the turbine wheel and compressor wheel arranged on the common turbocharger shaft;

a plurality of rolling element bearings which are spaced apart from one another in an axial direction of the common turbocharger shaft;

a rolling element bearing sleeve, which is arranged between and spaces two of the plurality of rolling element bearings apart;

a locating hole formed as part of the housing, the common turbocharger shaft mounted in the locating hole in the housing of the turbocharger device by the plurality of rolling element bearings;

a groove formed on the outside of the rolling element bearing sleeve, such that the groove extends in a circumferential direction;

a plurality of chamfered outer edges integrally formed as part of the groove;

a hole integrally formed as part of the housing of the turbocharger device, such that the hole extends perpendicularly to the housing axis; and at least two pins, wherein the at least two pins are arranged in the hole such that the at least two pins are pressed against the chamfered outer edges of the groove.

2. The turbocharger device of claim 1, wherein the plurality of chamfered outer edges of the groove are chamfered at different angles.

3. The turbocharger device of claim 1, wherein each of the at least two pins is of semicircular design in cross section.

4. The turbocharger device of claim 3, wherein the at least two pins together form a full circle in cross section in the state in which the at least two pins are inserted into the hole.

5. The turbocharger device of claim 1, wherein at least one of the tips or heads of each of the at least two pins is designed as a partial cone.

6. The turbocharger device of claim 1, wherein the combined outside diameter of the at least two pins is greater than the width of the groove formed as part of the rolling element bearing sleeve.

7. The turbocharger device of claim 1, wherein the contact between at least one of tips or heads of the pins and at least one of the plurality of chamfered outer edges of the groove further comprises one of a point, line, or surface contact.

8. The turbocharger device of claim 1, wherein the at least two pins are arranged in the hole spaced apart from one another.

9. A method for mounting a turbocharger device, comprising the steps of:

providing a housing having a housing axis;

providing a common turbocharger shaft;

providing a plurality of rolling element bearings;

providing a rolling element bearing sleeve;

providing a groove formed on the outside of the rolling element bearing sleeve, such that the groove extends in a circumferential direction;

providing a plurality of chamfered outer edges being formed as part of the groove;

providing a hole integrally formed as part of the housing of the turbocharger device, and the hole extends perpendicularly to the housing axis; and providing at least two pins;

mounting the plurality of rolling element bearings and the rolling element bearing sleeve onto the common turbocharger shaft;

pushing the housing over the plurality of rolling element bearings and the rolling element bearing sleeve until the groove in the rolling element bearing sleeve and the hole in the housing are substantially aligned relative to one another;

arranging the at least two pins into the hole integrally formed as part of the housing;

pressing at least one of tips or heads of the at least two pins against one or more of the plurality of chamfered outer edges of the groove to fix the rolling element bearing sleeve in an axial direction.

* * * * *